US007322804B2

(12) United States Patent
Humburg

(10) Patent No.: US 7,322,804 B2
(45) Date of Patent: Jan. 29, 2008

(54) METERING PUMP DEVICE FOR A VEHICLE HEATER

(75) Inventor: Michael Humburg, Göppingen (DE)

(73) Assignee: J. Eberspächer GmbH & Co. KG, Esslingen (DE)

( * ) Notice: Subject to any disclaimer, the term of this patent is extended or adjusted under 35 U.S.C. 154(b) by 535 days.

(21) Appl. No.: 10/757,157

(22) Filed: Jan. 13, 2004

(65) Prior Publication Data

US 2005/0047941 A1 Mar. 3, 2005

(30) Foreign Application Priority Data

Jan. 14, 2003 (DE) ..... 103 01 093

(51) Int. Cl.
*F04B 17/04* (2006.01)
*F04B 35/04* (2006.01)

(52) U.S. Cl. ..... 417/416; 417/525; 417/545

(58) Field of Classification Search ..... 417/416, 417/109, 199.2, 259, 260, 262, 298, 404, 417/525, 545

See application file for complete search history.

(56) References Cited

U.S. PATENT DOCUMENTS 3,809,507 A 5/1974 Baglai
4,349,130 A * 9/1982 Bair ..... 222/129.2
4,560,327 A * 12/1985 Bez et al. ..... 417/493
6,152,710 A * 11/2000 Oh et al. ..... 417/570
6,186,118 B1 * 2/2001 Spakowski ..... 417/549
6,193,477 B1 2/2001 Falk
6,796,777 B2 * 9/2004 Falk et al. ..... 417/417

FOREIGN PATENT DOCUMENTS

DE 42 05 290 A1 2/1992
DE 101 03 224 C1 1/2001
GB 2 180 301 A 3/1987

OTHER PUBLICATIONS

Examination Report dated Apr. 9, 2003 from German Patent Office for German Priority Application 103 01 093.9.

* cited by examiner

*Primary Examiner*—Anthony D. Stashick
*Assistant Examiner*—Peter J Bertheaud

(57) ABSTRACT

A metering pump device for a vehicle heater includes an inlet chamber, an outlet chamber, a first valve arrangement between the inlet chamber and the outlet chamber, which permits a fluid exchange substantially only from the inlet chamber to the outlet chamber, a displacement piston element, which in a first piston position minimizes the volume of the inlet chamber and in a second piston position minimizes the volume of the outlet chamber.

11 Claims, 5 Drawing Sheets

METERING PUMP DEVICE FOR A VEHICLE HEATER

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to a metering pump device for a vehicle heater.

TECHNICAL FIELD OF THE INVENTION

Heating devices used in vehicles, for example as supplementary heaters or as additional heaters, are in general operated with the same fuel as used in the drive assembly used in such a vehicle. It is therefore necessary to supply a correspondingly adapted amount of fuel to such a heating device according to the delivered heating power. Metering pump devices are generally used for this purpose and must be capable of delivering comparatively small amounts of fuel in a precisely metered manner to the heating device so as to permit the combustion to proceed in the required manner, i.e. above all with minimum pollutant production.

A metering pump arrangement is known from German Patent Document DE 101 03 224 C1, in which a pump piston can reciprocate in a pump chamber. According to the operating cycle, this pump chamber is connected either to a fuel supply region or to a fuel delivery region, so that, for example, with the pump chamber connected to the fuel supply region, fuel is introduced into the pump chamber by increasing the pump chamber volume on pulling back the pump piston, and in a following operating cycle, after connecting the pump chamber with the fuel delivery region and reducing the volume of the pump chamber by pushing the pump piston back, fuel is delivered. This manner of operation has the consequence that, for example, the pump piston is effective only on every other stroke, for receiving or sucking fluid to be delivered into the pump chamber, and in a corresponding manner, is effective on only every other stroke for receiving the previously received fluid.

From German Patent Document DE 42 05 290 O1, an electromagnetically operated pump is known in which a displacement piston element can be periodically reciprocated between a position in which the volume of an inlet chamber is minimum and a position in which the volume of an outlet chamber is minimum. The volume change of the inlet chamber or outlet chamber is obtained in that a piston section of the displacement piston element is guided in a cylindrical housing and is immersed more or less into this. Since the piston section, displaceable in the cylindrical housing and immersed, more or less, in this, has a constant external cross section over its length, a displacement of the displacement piston element results in a change of the volume of the inlet chamber and the volume of the outlet chamber to the same extent. The first valve arrangement is provided within the piston section and is thus movable back and forth with this. The fluid expelled on minimizing the volume of the inlet chamber first enters an internal space region of the piston section, and leaves this through passage openings in the direction toward the remaining volume region of the outlet chamber.

SUMMARY OF THE INVENTION

The object of the present invention is to provide a metering pump for a vehicle heater, having improved delivery effect with a simple construction.

According to the present invention, this object is attained by a metering pump for a vehicle heater, comprising an inlet chamber and outlet chamber, a first valve arrangement between the inlet chamber and the outlet chamber, so as to permit a fluid exchange substantially only from the inlet chamber to the outlet chamber, a displacement piston element which is moveable between a first piston position in which it minimizes the volume of the inlet chamber, and a second piston position in which it minimizes the volume of the outlet chamber, a volume decrease of the inlet chamber, on movement of the displacement piston element from the first piston position to a second piston position is greater than a volume increase of the outlet chamber.

An essential feature of the metering pump device according to the invention is that the metering pump device has two chambers separated by a first valve arrangement, and that either the volume of the inlet chamber or the volume of the outlet chamber is minimized by the displacement piston element according to the direction of motion or motion cycle. However, it follows from this that whenever, for example, the displacement piston element comes into the second piston position, and thus moves in a given direction of motion or a given mode of motion, this volume of the outlet chamber is minimized, and thereby fluid to be forwarded is ejected from this outlet chamber. Correspondingly, with an oppositely directed movement, in which then on each movement in this direction or in this mode volume of the inlet chamber is minimized, and because of the action of the first valve arrangement, fluid to be forwarded is transferred from the inlet chamber to the outlet chamber. Since the volume of the inlet chamber and the volume of the outlet chamber do not change to the same extent on reciprocation of the displacement piston element, but the volume change for the inlet chamber is greater than for the outlet chamber, a movement of the displacement piston element toward the first piston position, that is, a movement in which the volume of the inlet chamber is decreased, has a consequence that fluid thus displaced from the inlet chamber cannot be completely received in the outlet chamber since its volume does not increase to the same extent. It results from this that in one working cycle, in which the displacement piston element moves in the direction for minimizing the volume of the inlet chamber and maximizing the volume of the outlet chamber, the excess portion of the fluid volume displaced from the inlet chamber and not receivable in the outlet chamber is ejected outward. On moving back in the direction of the second piston position, the volume of the outlet chamber is then minimized with the consequence that upon this movement also, because of the presence of the first valve arrangement, fluid is ejected externally from the outlet chamber. The consequence thereof is that in contrast to the said prior art, the delivery cycle or the delivery frequency of the metering pump device according to the invention is increased so that there follows a markedly higher frequency delivery of fluid to be delivered to the vehicle heater, which results in an improved approximation to a quasi-continuous fluid flow.

The structure of the metering pump device according to the invention can, for example, be such that in the first piston position the displacement piston element is inserted with a first piston region into the inlet chamber, and in the second piston position the displacement piston element is inserted with a second piston region into the outlet chamber.

The different changes of the volume of the inlet chamber and of the volume of the outlet chamber upon movement of the displacement piston element which ultimately induces due to its movement both volume changed by its movement, can, for example, obtained in that the displacement piston element has in a first piston region a first displacement surface effective on movement of the displacement piston element in the direction toward a first piston position, and in a second piston region has a second displacement surface effective on movement of the displacement piston element in the direction toward the second piston position, and that the first displacement surface is greater than the second displacement surface.

A comparison of the fluid flow ejected outward in the direction to a continuous or quasi-continuous fluid flow can thereby still be supported in that the first displacement surface and the second displacement surface have a mutual surface ratio of 2:1. In an embodiment which is easy to obtain constructionally and which operates stably, it can be provided that the displacement piston element has a piston section providing the first piston region and the second piston region, and also a displacement section which can become inserted into the outlet chamber upon movement of the displacement piston element from the first piston position to the second piston position.

A construction, which is particularly easy to realize, can provide that the displacement piston element is displaceable between the first piston position and the second piston position. For this purpose, it is, for example, possible that the displacement piston element is displaceable in a piston housing with cylindrical aperture wherein the piston housing the region of the inlet chamber, into which the first piston region is inserted in the first piston position and the region of the outlet chamber into which a second piston region is inserted in the second piston region, are at least partially formed.

In order to be able to realize the inlet chamber and the outlet chamber in a simple manner in the metering pump device according to the invention, it is proposed that the piston housing is surrounded at least regionally by a chamber housing, and that the inlet chamber and/or the outlet chamber is at least partially formed between the piston housing and the chamber housing.

The introduction into the inlet chamber of fluid to be delivered can, for example, take place in that a fluid supply duct is provided in the displacement piston element, and has at the first piston region a mouth to the inlet chamber, and is displaceable by a second valve arrangement, which permits fluid exchange substantially only from the fluid supply duct to the inlet chamber.

In order to reliably make the fluid flow in only one direction possible, it is proposed that the first valve arrangement and/or the second valve arrangement is formed as a check valve. For example, it can be provided for this that the first valve arrangement and/or the second valve arrangement has a spring-loaded valve element.

An electromagnetic drive can be provided for producing the movement of the displacement piston element, and can, for example, comprise a coil/armature arrangement, in which the armature is formed by the displacement piston element.

According to a further aspect, the present invention comprises a metering pump device for a vehicle heater, comprising an inlet chamber, and outlet chamber, a first valve arrangement between the inlet chamber and the outlet chamber which connects fluid exchange substantially only from the inlet chamber to the outlet chamber, a displacement piston element, which in a first piston position minimizes the volume of the inlet chamber, and in a second piston position minimizes the volume of the outlet chamber, the first valve arrangement comprising a valve seat and a valve element which can be pressed against the valve seat, the valve seat of the first valve arrangement being provided on a housing which receives the displacement piston element.

BRIEF DESCRIPTION OF THE DRAWINGS

The present invention is described in detail below with reference to the accompanying drawings and using preferred embodiments.

DETAILED DESCRIPTION OF THE INVENTION

Figure 1:
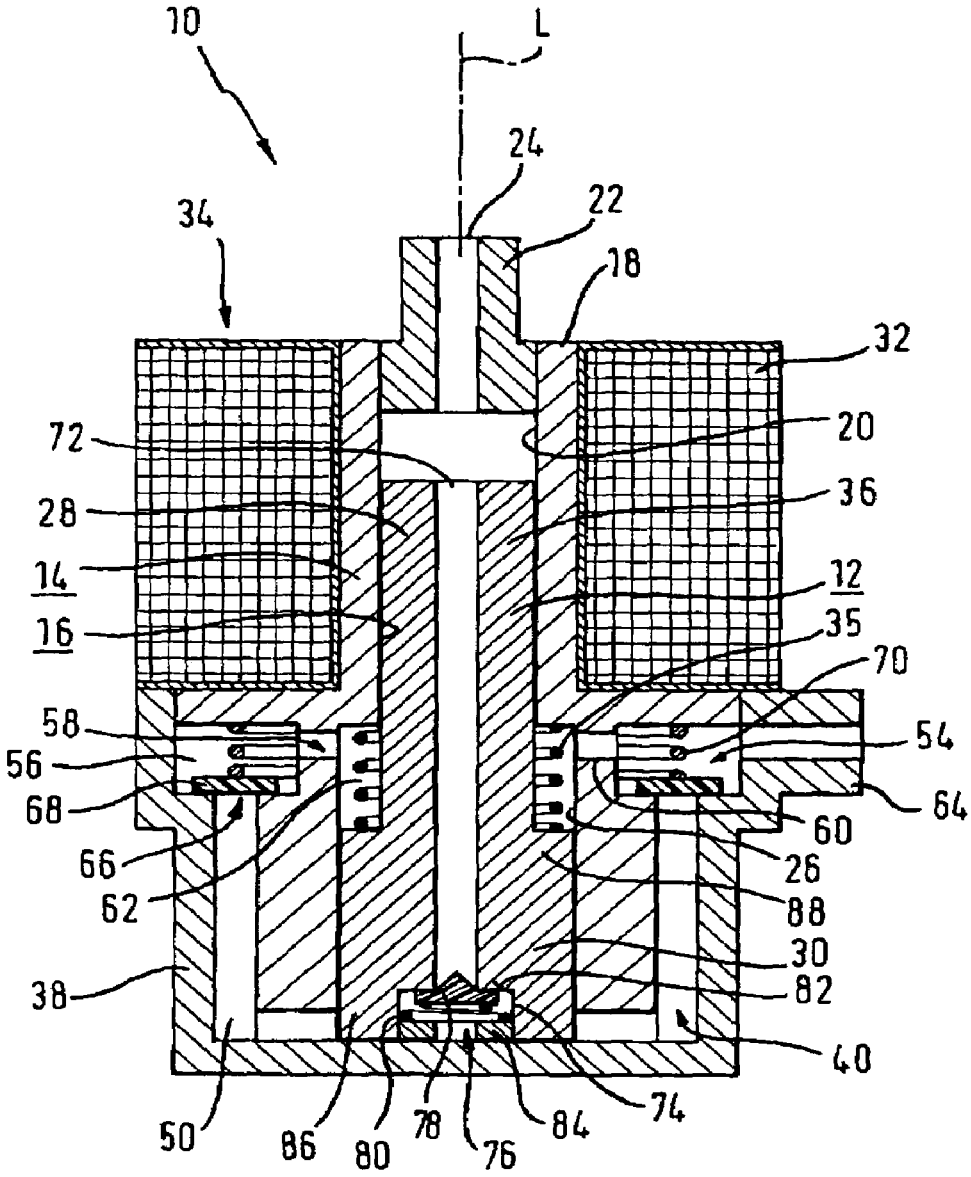
FIG. 1 shows a longitudinal sectional view of a measuring pump device according to the invention with a displacement piston element inserted completely into an inlet chamber in a first piston position.

FIG. 1 shows a metering pump device 10 according to the invention, in longitudinal section, sectioned along a longitudinal midline of a displacement piston element generally denoted by 12. The metering pump device 10 comprises a piston housing 14, in which is provided an aperture 16, of stepped construction, extending substantially cylindrically in the direction of the longitudinal axis L. At one end region 18 of the piston housing 14 an inlet pipe element 22 is formed with an inlet opening 24, and is positioned engaging the aperture 16 of the section 24 of smaller diameter thereof. This inlet pipe element 22 can, for example, be connected via a flexible duct, etc., to a fuel reservoir.

Matching the stepped configuration of the opening of the aperture 16 with its section 20 with smaller diameter and a section 26 with greater diameter, the displacement piston element 12 is of corresponding stepped construction and has a section 28 with smaller diameter, and also a section 30 with greater diameter. Here the section 28 with smaller diameter is matched as regards its dimension with the smaller diameter at the section 20 of the aperture 16, and in a corresponding manner the section 30 of the displacement piston element 12 is matched to the section 26 of the aperture 16, so that the displacement piston element 12 is guided with a very accurate fit in the two aperture sections 20, 26. In order to be able to produce a tight closure, it is, for example, possible to provide sealing elements, such as e.g. sealing rings or the like, on the section 30 of the displacement piston element 12 on its outer periphery.

In that region of the piston housing 14 in which the section 20 of the aperture 16 is formed, this is surrounded by a coil 32. The coil 32 forms a portion of an electromagnetic drive 34. The displacement piston element 12 forms with its section 28 that is regionally inserted into the coil 32 an armature 36. On excitation of the coil 32, the resulting automating electromagnetic effect, the displacement piston element 12 is displaced upward, against the effect of a prestressing spring 34 from the piston position shown in FIG. 1 in the direction of the inlet pipe element 22. The prestressing spring 34, which, for example, can be formed as a coil compression spring, is supported on the step-like transition between the sections 20, 26 of the aperture 16 on the one hand, and on the step-like transition between the sections 28 and 30 of the displacement piston element 12 on the other hand. If the excitation of the coil 32 is ended or reduced, the displacement piston element 12 is again moved into the piston position shown in FIG. 1, under the prestressing effect of the prestressing spring 34.

Figure 2:
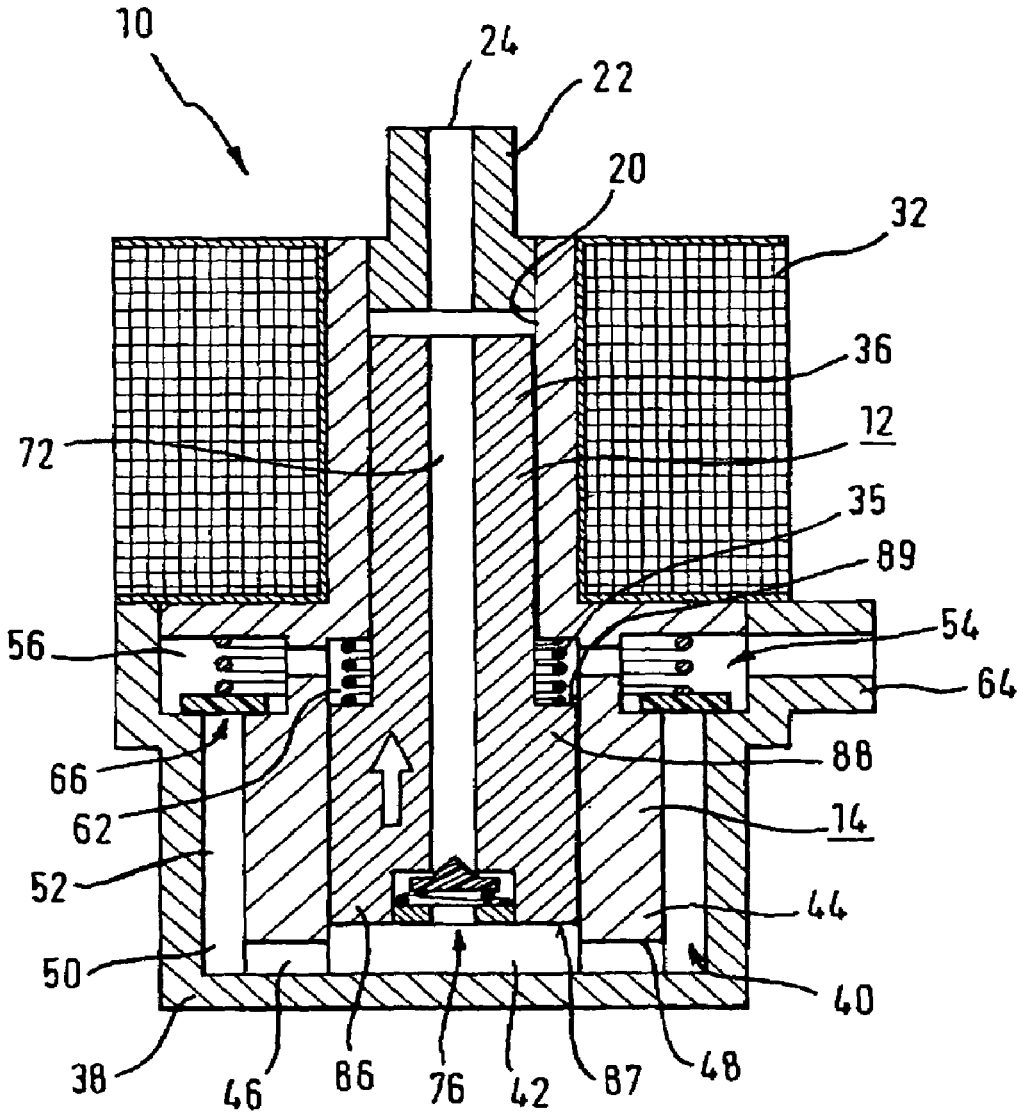
FIG. 2 shows the metering pump device of FIG. 1 upon transition of the piston element from the first piston position to a second piston position.
Figure 3:
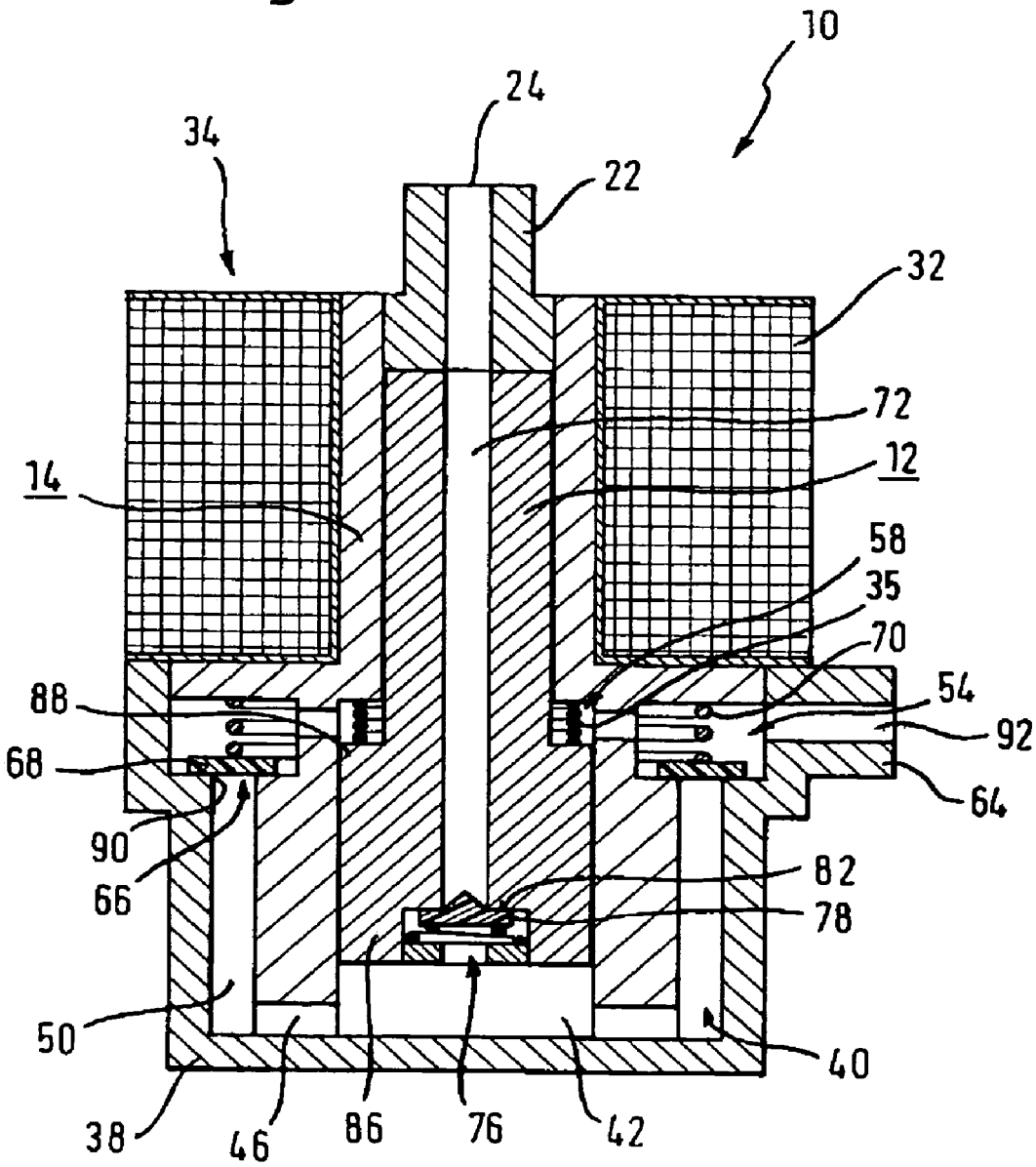
FIG. 3 shows the metering pump device according to the invention, with a displacement piston element positioned in the second piston position and inserted completely into an outlet chamber.

Adjoining the portion of the piston housing 14 surrounded by the coil 32, this is surrounded by a chamber housing 38 formed with a pot-like structure. The inlet chamber 40, which can also be best seen in FIG. 2, is formed in this manner. This inlet chamber 40 includes a first inlet chamber region 42, which is essentially provided at the axial end region 44 of the piston housing 14 and provided there by the section 26 of the aperture 16. A second inlet chamber region 46 includes at least one preferably, plural, aperture 48 leading radially outward in the end region of the piston housing 14. A third inlet chamber region 50 includes a substantially cylindrical volume region 52, of annular form, between the piston housing 14 chamber housing 38.

Furthermore an outlet chamber, generally denoted 54, is formed by the cooperation of the piston housing 14 and chamber housing 38. This includes an annular outlet chamber region 56 adjoining the inlet chamber region 50, and also an outlet chamber region 58 leading radially inward from this, and including at least one aperture 60 in the piston housing 14. These aperture(s) 60 or the outlet chamber region 58 are open radially inward to the section 26 of the opening 14 in the piston housing 14, and in fact into a region of the same formed in a step-like transition between the sections 20 and 26, in which the prestressing spring 34 is also received. This volume region of the aperture section 26 forms a further outlet chamber region 62. The metering pump device 10 can be connected, by an outlet pipe 64 provided on or integral with the chamber housing 38: for example, a vehicle heating device.

A first valve arrangement 66 includes an annular valve member 68 which abuts, under the prestressing effect of a further prestressing spring 70, on a step-like transition formed on the piston housing 14 and also on the chamber housing 38, between the outlet chamber region and the inlet chamber region. Thus this first valve arrangement 66, formed as a check valve, ensures that a fluid flow can take place substantially only from the inlet chamber region 50 to the outlet chamber region 56, and not in the reverse direction.

In the displacement piston element 12 a supply duct 72 extending longitudinally of the same is formed. This supply duct 72 is open to the opening section 20 of the aperture 16 in the piston housing 14, and is thus also open to the inlet opening 24 of the inlet pipe element 22. This supply duct 72 to the inlet chamber 40 opens at the section 30 of the displacement piston element 12. Furthermore, the supply duct 72 can be closed by a second valve arrangement 76 at this opening region 74. This second valve arrangement 76 includes a valve member 78 of disk-like form, which is prestressed under the prestressing action of a further prestressing spring 80 against a valve seat 82 formed on a step-like widening transition of the aperture providing the supply duct 72 in the displacement piston element 12, the spring 80 being supported on a support element 84 connected to the displacement piston element 12. This second valve arrangement 76 thus ensures that a fluid flow from the fluid supply duct 72 is possible in the direction towards the inlet chamber 40, while a fluid flow in the opposite direction is not possible.

The manner of operation of the metering pump device 10, previously described in detail as regards its construction, particularly with reference to FIGS. 1 and 2, is described hereinbelow with reference to FIGS. 1-4.

In FIG. 1, the displacement piston element 12 is in a first piston position, in which it is held by the prestressing action of the prestressing spring 34. In this first piston position, the displacement piston element 12 is inserted with a piston region 86 of maximum extent into the inlet chamber 40, so that the inlet chamber region 42 so that the inlet chamber region 42 is substantially completely filled by the piston region 86 of the piston displacement element 12, and thus the total volume of the inlet chamber 40 is minimized. Starting from a state in which the displacement piston element 12 is thus in its first piston position and the volume of the inlet chamber 40 is a minimum, while the volume of the outlet chamber 54 is a maximum, the displacement piston element 12 is displaced against the prestressing effect of the prestressing spring 34, by excitation of the coil 32, the volume of the inlet chamber 40 not occupied by the displacement piston element 12 thus increases, while simultaneously the displacement piston element 12 is increasingly displaced with a second piston region 88 into the outlet chamber region 58, in which the prestressing spring, increasingly compressed, is also arranged in this movement process. In this process the total volume of the outlet chamber 54 which is not occupied by the displacement piston element 12, and in which fluid to be delivered can thus be arranged, is reduced, as far as the state which can be seen in FIG. 3, in which the displacement piston element 12 is in a second piston position, this volume is minimized. With this movement, the displacement piston element 12 displaces fluid from the outlet chamber region 62 with an axial end face effective as a displacement surface 89.

With the transition into this second piston position, the inlet pipe element 22 can form a movement stop for the displacement piston element 12, and in fact already before the prestressing spring 34 is completely compressed and thus set to block. With the transition from the state shown in FIG. 1, in which the displacement piston element 12 is in its first piston position, to the state shown in FIG. 3 in which the displacement piston element 12 is in its second piston position the volume of the inlet chamber 40 prepared to receive fluid is thus increased while the volume of the outlet chamber 54 available for fluid uptake is reduced. Depending on the mode of action of the two valve arrangements 66, 76 embodied as check valves, upon this transition by lifting the valve member 78 from its associated valve seat, fluid can flow in from the supply duct 72 into the inlet chamber 40, while by the prestressing effect of the prestressing spring 70 on the one hand and the increase of pressure in the outlet chamber 54 by reduction of the volume of the same on the other hand, the valve element 68 is increasingly pressed against its valve seating 90 on the piston housing 14 and on the chamber housing 38. While with this transition new fluid to be delivered is introduced into the inlet chamber 40, because the piston region 86 is increasingly withdrawn from the inlet chamber region 42, fluid already present in the outlet chamber 54 is displaced through the displacement surface 89 due to the second piston region 88, which is increasingly inserted into the outlet chamber region 58, so that it leaves the outlet chamber 54 via the outlet aperture 92 of the outlet pipe 64 and flows toward the heating device.

Figure 4:
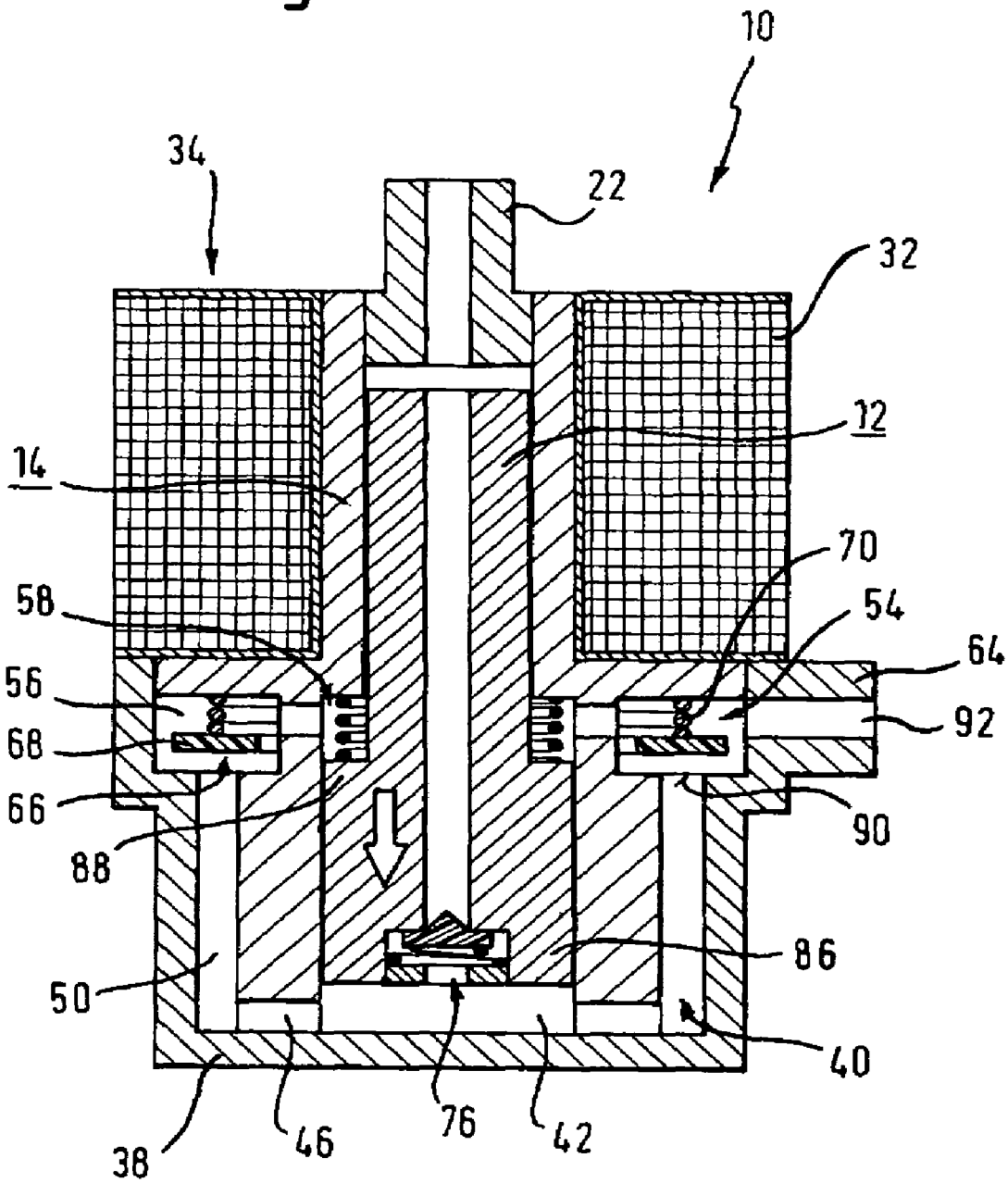
FIG. 4 shows the metering pump device according to the invention with a displacement piston element in transition from the second piston position to the first piston position.

If now the excitation of the coil 32 ends completely with the piston region 88 completely inserted into the outlet chamber region 58, the displacement piston element 12 returned, as is indicated in FIG. 4, in the direction of its first piston position. This means that the first piston region 86 is increasingly inserted further into the inlet chamber region 42, while the second piston element 88 is always drawn further out of the outlet chamber region 58. There thus occurs a reduction of the volume of the inlet chamber 40 available for fluid uptake, while simultaneously the volume of the outlet chamber 54 available for fluid uptake increases. With this movement, the displacement piston element 12 displaces with its section 30 or a displacement surface 87 into the fluid at first still contained in the inlet chamber region 42. By the displacement effect of the displacement piston element 12 and the now closing effect of the second valve arrangement 76, the valve member 68 of the first valve arrangement 66 is lifted against the prestressing effect of the spring 70 from its valve seat 90, so that the fluid displaced from the outlet chamber 40 can flow into the outlet chamber region 56. This process lasts until the displacement piston element 12 again reaches its first piston position shown in FIG. 1, in which the free volume of the inlet chamber 40 is minimized, and in the corresponding manner the volume ready to receive fluid is a maximum. It can be seen during the transition from the state shown in FIG. 3 to the state shown in FIG. 4 that with this movement of the displacement piston element 12 the volume change in the inlet chamber 40 on one hand and in the outlet chamber 54 on the other hand are not equal. Since the displacement piston element 12 is embodied substantially cylindrical in its section 30, and since the section 28 with smaller diameter is always at least partially inserted into the aperture section 20, the volume change in the region of the outlet chamber defined by the size of the substantially annular embodied displacement surface 89, multiplied by the stroke of the displacement piston element 12, while with the same stroke the piston region 86 is effective with a displacement surface 87 substantially including the whole cross section of the section 30 of the piston element. This means that the ratio of the volume change of the inlet chamber 40 to the volume change of the outlet chamber 54 is defined by the ratio of the size of the displacement surface 87 to the size of the displacement surface 89, thus the displacement surfaces effective in the respective movement. From this there results that upon a movement in which the volume of the inlet chamber 40 is reduced and simultaneously the volume of the outlet chamber 54 is enlarged, that fluid displaced from the inlet chamber 40 via the valve arrangement 66 toward the outlet chamber 54 cannot be completely received in this outlet chamber. The same volume portion of the fluid displaced from the inlet chamber 40, which exceeds the increase of volume of the outlet chamber 54, is displaced outward by the outlet chamber 54 upon this movement of the displacement piston element 12 toward minimizing the volume of the inlet chamber 40 and is thus delivered to a system receiving the fluid. There furthermore results that not only upon movement from the piston position shown in FIG. 1 to the piston position shown in FIG. 3 and thus a movement in the direction of reducing the volume of the outlet chamber 54, fluid is ejected outward from the outlet chamber 54; but also in the opposite direction and thus a movement to reduce the volume of the inlet chamber 40 or to increase the volume of the outlet chamber 54, fluid is ejected outward via the outlet chamber 54. Thus results a manner of operation in which fluid is ejected upon each stroke of the displacement piston element 12, independent of the stroke direction. A marked increase of the ejection frequency is thereby obtained, with the result that an approximation to a continuous or quasi-continuous fluid flow is obtained. This can, in particular, be supported in that, by corresponding dimensioning of the two displacement surfaces 87 and 89, the volume changes of the inlet chamber 40 or of the outlet chamber 54 are adapted to each other so that they are in the ratio 2:1. I.e., upon reduction of the volume of the inlet chamber 40, a half volume of the displaced fluid in the outlet chamber 54 can be received by volume increase of the same, while the second half can no longer be received in the outlet chamber 54 and is ejected outward. With the opposite movement, exactly one volume fraction is ejected, which corresponds to the decrease of the volume of the outlet chamber 54, and thus in turn a volume that corresponds to half the volume change of the inlet chamber. Thus with each stroke of the displacement piston element 12, substantially the same fluid quantity is ejected outward.

Figure 5:
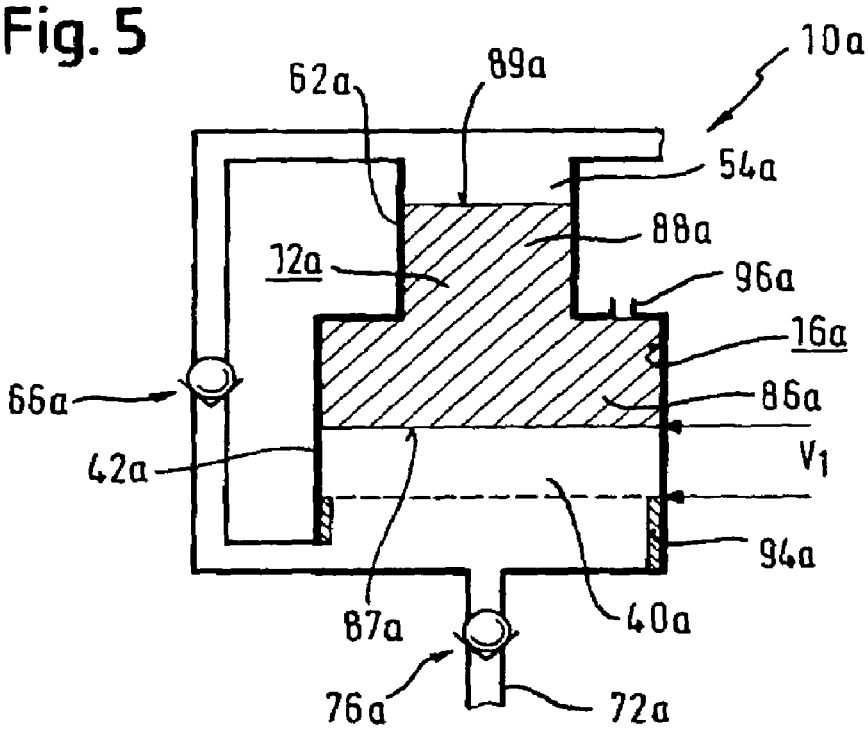
FIG. 5 shows a representation of principal of a metering pump device according to the invention with maximum inlet chamber volume.
Figure 6:
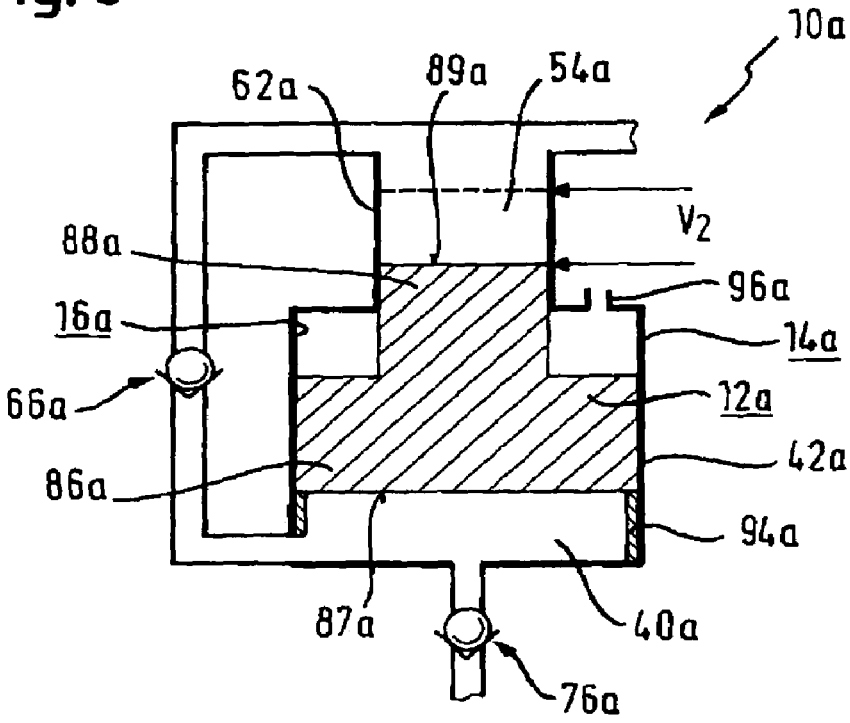
FIG. 6 shows the metering pump device shown in FIG. 5 at maximum outlet chamber volume.

An alternative embodiment of a metering pump device constructed according to the principles of the present invention is shown in FIGS. 5 and 6. Components, which correspond in construction of function to previously described components, are denoted by the same reference number with the attachment of a subscript "a". It is first seen in FIG. 5 at the section present in a previous embodiment the smaller diameter of the displacement piston element, which extends out over the outlet chamber into the aperture section 20, is not present. Instead, the displacement piston element 12*a* is formed substantially step-like, and has at its two ends in the axial direction, that is the direction of motion, the displacement surfaces 87*a*, 89*a* in the piston regions 86*a* or 88*a* respectively. By the stepped embodiment of the displacement piston element 12*a*, which is received in a corresponding stepped aperture 16*a* of the piston housing 14*a* it is further obtained that the two displacement surfaces 87*a*, 89*a* have a size ratio different from 1, for example furthermore a ratio of 2:1.

If the displacement piston element 12*a*, first held in a position of maximum inlet chamber volume, moves in a direction to reduce the volume of the inlet chamber 40*a*, the volume of the inlet chamber 40*a* thus decreases, while simultaneously the volume of the outlet chamber 54*a* increases. If, for example, the displacement piston element 12*a* moves so far that it comes to abut with its piston region 86*a* on a stop 94*a*, for example, again under prestress of a spring (not shown), the volume of the inlet chamber 40*a* changes corresponding to the stroke provided by the size of the displacement surface 87*a* by a magnitude V1. Since the piston region 88*a* is displaced to the same extent, the volume of the outlet chamber 54*a* changes by a volume V2, which results from the previously mentioned stroke of the displacement piston element 12*a* multiplied by the size of the displacement surface 89*a*. Here also, there occurs the same effect, that the volume V1 displaced from the inlet chamber 40*a* cannot be completely received in the outlet chamber 54*a*, the volume of which has increased only by the magnitude V2. That is, the volume portion of the displaced fluid that cannot be received in the outlet chamber 54*a* is discharged outward.

In order not to make this movement of the displacement piston element 12*a* difficult, a ventilating/aspirating opening 96*a* can be provided which facilitates the penetration or escape of air in the opening 16*a* of the piston housing 14*a*.

It can further be seen in the embodiment shown in FIGS. 5 and 6 at a supply duct 72*a* is now provided which opens via the second valve arrangement 76*a* directly into the inlet chamber 40*a*, and thus does not lead through the displacement piston element 12*a*.

If the movement of the displacement piston element 12*a* takes place from the position of maximum inlet chamber volume shown in FIG. 5 to the position of maximum outlet chamber volume in FIG. 6, of maximum outlet chamber volume with spring prestressing, the return motion can then take place by electromagnetic alternating action as previously described. It is of course possible to provide the prestressing in the other direction.

It can be seen from the above description of the manner of operation of the metering pump device according to the invention, that each movement of the displacement piston element leads to an ejection cycle. At a predetermined frequency of movement of the displacement piston element, this means a doubling of the forwarding of the displacement frequency in comparison with the metering pump arrangement known from the prior art, with a markedly more uniform flow characteristic of the fuel delivered to a heating device.

The metering pump arrangement, according to the invention, has only a single member to be moved by a corresponding drive, which simplifies the construction and reduces the number of components required. Further, a very compact construction is provided, particularly by the passage of the fluid supply through the compression piston element 12, and there is no moveable component to be outwardly sealed.

I claim:

1. A Metering pump device for a vehicle heater, comprising an inlet chamber (40), an outlet chamber (54), a first valve assembly (66) between the inlet chamber (40) and the outlet chamber (54), which permits fluid exchange substantially only from the inlet chamber (40) to the outlet chamber (54), a displacement piston element (12), which is movable to and fro in an opening (16) formed in a piston housing (14) between a first piston position, in which it minimizes the volume of the inlet chamber (40) and a second piston position, in which it minimizes the volume of the outlet chamber (54), a reduction ($V_1$) in the volume of the inlet chamber (40) being greater than an increase ($V_2$) in the volume of the outlet chamber (54) on movement of the displacement piston element (12) from the second piston position to the first piston position, wherein the opening (16) is of stepped construction, with a portion (20) of smaller diameter and a portion (26) of larger diameter, the displacement piston element (12) comprises a portion (28) of smaller diameter, the size of which is conformed to the smaller diameter portion (20) of the opening (16) and which is guided in the smaller diameter portion (20) of the opening (16), the displacement piston element (12) comprises a portion (30) of larger diameter, the size of which is conformed to the larger diameter portion (26) of the opening (16) and which is guided in the larger diameter portion (26) of the opening (16), the piston housing (14) is surrounded by a coil (32)of an electromagnetic drive (34) in the region in which the smaller diameter portion (20) of the opening (16) is formed, the displacement piston element (12) is inserted with its smaller diameter portion (28) into the coil (32) and forms an armature (36) of the electromagnetic drive (34), a fluid feed line is provided in the displacement piston element (12), which line is open at the smaller diameter portion (28) of the displacement piston element (12) to the smaller diameter portion (20) of the opening (16), which comprises an orifice leading to the inlet chamber (40) at the larger diameter portion (30) of the displacement piston element (12) and which is closable by a second valve assembly (76), which permits fluid exchange substantially only from the fluid feed line (12) to the inlet chamber (40).

2. A metering pump device according to claim 1, characterized in that in the first piston position the displacement piston element (12) is inserted with a first piston region (86) into the inlet chamber (40) and in the second piston position the displacement piston element (12; 12*a*) is inserted with a second piston region (88) into the outlet chamber (54; 54*a*).

3. A metering pump device according to claim 1, characterized in that, in a first piston region (86), the displacement piston element (12) comprise a first displacement surface effective upon movement of the displacement piston element (12) in the direction of the first piston position and, in a second piston region (88), it comprises a second displacement surface (89) effective upon movement of the displacement piston element (12) in the direction of the second piston position, and in that the first displacement surface (87) is larger than the second displacement surface (89).

4. A metering pump arrangement according to claim 3, characterized in that the first displacement surface (87) and the second displacement surface (89) have a mutual surface ratio of 2:1.

5. A metering pump arrangement according to claim 2, characterized in that the displacement piston element (12) comprises a piston portion (30) providing the first piston region (86) and the second piston region and a displacement portion (28) which is inserted into the outlet chamber (54) upon movement of the displacement piston element (12) from the first piston position to the second piston position.

6. A metering pump device according to claim 1, characterized in that the displacement piston element (12) is displaceable between the first piston position and the second piston position.

7. A metering pump device according to claim 1, characterized in that the region (42) of the inlet chamber (40) into which the first piston region (86) is inserted in the first piston position, and the region (62) of the outlet chamber (54) into which the second piston region (88) is inserted in the second piston position are constructed at least in part in the piston housing (14).

8. A metering pump device according to claim 7, characterized in that the piston housing (14) is surrounded at least in places by a chamber housing (38) and in that the inlet chamber (40) and/or the outlet chamber is/are formed at least in pan between the piston housing (14) and the chamber housing (38).

9. A metering pump device according to claim 1, characterized in that the first valve assembly (66) andlor the second valve assembly (76) takes the form of a non-return valve.

10. A metering pump device according to claim 9, characterized in that the first valve assembly (66) and/or the second valve assembly (76) comprises a spring-biased valve member (68, 78).

11. A metering pump device according to claim 1, characterized in that the first valve assembly (66) comprises a valve seat (90) and a valve member (68) which may be pressed against the valve seat (90), the valve seat (90) of the first valve assembly (66) being provided on a housing (14, 38) accommodating the displacement piston element (12).

* * * * *